US008844845B2

(12) United States Patent
Chen

(10) Patent No.: US 8,844,845 B2
(45) Date of Patent: Sep. 30, 2014

(54) VOLUME ADJUSTABLE BLOW GUN

(76) Inventor: Wan-Pao Chen, Changhua Hsien (TW)

( * ) Notice: Subject to any disclaimer, the term of this patent is extended or adjusted under 35 U.S.C. 154(b) by 254 days.

(21) Appl. No.: 13/482,988

(22) Filed: May 29, 2012

(65) Prior Publication Data

US 2013/0299612 A1 Nov. 14, 2013

(30) Foreign Application Priority Data

May 9, 2012 (TW) ..... 101208668 U

(51) Int. Cl.

| | |
|---|---|
| ***B05B 7/02*** | (2006.01) |
| ***B05B 15/06*** | (2006.01) |
| ***B05B 1/30*** | (2006.01) |
| ***B05B 1/00*** | (2006.01) |

(52) U.S. Cl.

USPC ..... 239/526; 239/525; 239/532; 239/569; 239/586; 239/589

(58) Field of Classification Search

USPC ..... 239/525, 526, 532, 569, 583, 586, 589

See application file for complete search history.

(56) References Cited

U.S. PATENT DOCUMENTS

| | | | | |
|---|---|---|---|---|
| 3,129,892 | A * | 4/1964 | Tillman | 239/417.3 |
| 3,263,934 | A * | 8/1966 | Hope, Jr. et al. | 239/556 |
| 3,780,949 | A * | 12/1973 | Gavin | 239/291 |
| 3,790,085 | A * | 2/1974 | Ayer | 239/291 |
| 3,814,329 | A * | 6/1974 | Clark | 239/426 |
| 6,626,382 | B1 * | 9/2003 | Liu | 239/569 |
| 8,066,205 | B2 * | 11/2011 | Bass et al. | 239/526 |
| 2003/0006313 | A1 * | 1/2003 | Jou | 239/398 |
| 2003/0189111 | A1 * | 10/2003 | Heren et al. | 239/570 |
| 2004/0222320 | A1 * | 11/2004 | Wu | 239/526 |
| 2007/0057092 | A1 * | 3/2007 | Huang | 239/527 |
| 2008/0054104 | A1 * | 3/2008 | Tremblay et al. | 239/586 |
| 2009/0224073 | A1 * | 9/2009 | Hsieh | 239/394 |

* cited by examiner

*Primary Examiner* — Justin Jonaitis
*Assistant Examiner* — Thomas Berez

(57) ABSTRACT

A blow gun includes a body with a top path and a bottom path, and a volume adjustment device is installed between the top and bottom paths. The volume adjustment device is in contact with a press rod which has one end pivotably connected to the body. The opening of the press rod is controlled by operation of the volume adjustment device so as to change the volume of the pressurized air. The press rod can also be locked at a position so that it is not activated unintentionally.

7 Claims, 8 Drawing Sheets

VOLUME ADJUSTABLE BLOW GUN

FIELD OF THE INVENTION

The present invention relates to a blow gun, and more particularly, to a blow gun with a press rod which controls an opening to adjust the volume of air passing through the blow gun.

BACKGROUND OF THE INVENTION

The conventional blow gun is used for removing dust by pressurized air flow, especially for those positions where the user's hand cannot reach such as positions in ducts, narrow spaces or high positions. The blow gun uses pressurized air to generate air flow to remove the dust from the positions mentioned above.

As shown in FIG. 7, the conventional blow gun 8 has a valve 81 and a spring 82 respectively connected to different axes of the blow gun 8. The valve 81 and the spring 82 respectively bias the top and bottom of the press rod 83 and are not located perpendicular to each other. The spring 82 easily reaches its fatigue point when the press rod 83 is operated for a period of time, and this causes leakage from the valve 81.

FIG. 8 shows Taiwanese Patent TW-M417959, wherein the blow gun 90 is connected with a source of pressurized air and the volume adjustable device 94 is exposed on the outside of the blow gun 90 and the volume of the pressurized air can be adjusted by rotating the knob 941 of the volume adjustable device 94. The knob 941 is connected with the valve blade 931 of the valve 93 so that the valve blade 931 is rotated between the first position and the second position. When the valve blade 931 is at the first position, the curved and concaved surface of the valve blade 931 seals the outlets 911, 921 to the inlet paths 91, 92, therefore, the pressurized air cannot enter into the path 95. When the valve blade 931 is at the second position, the valve blade 931 opens the outlets 911, 921. In other words, the valve blade 931 is in the closed position at the first position and in the open position at the second position. The valve blade 931 can also be positioned between the first and second positions to adjust the volume of the pressurized air.

Although the valve blade 931 can be positioned between the first and second positions to adjust the volume of the pressurized air, the opening of the trigger 96 cannot be controlled so that the trigger 96 may be unintentionally touched to action and this may result in dangerous situations.

The present invention intends to provide a volume adjustable device for a blow gun so as to adjust the volume of air passing through the blow gun.

SUMMARY OF THE INVENTION

The present invention relates to a blow gun and comprises a body having a top path and a bottom path. An inlet communicates with the lower end of the bottom path and an outlet communicates with the top of the top path. A handle is connected to the body and has a space defined therein which communicates with the top and bottom paths. A volume adjustment device is installed in the space and in contact with a press rod which has one end pivotably connected to the body and is in contact with the lower end of the volume adjustment device. A blowing tube is connected to the top path.

Preferably, the space has a first hole and a second hole which is smaller than the first hole so as to define a first stepped portion between the first and second hole. The top path communicates with the second hole and the bottom path communicates with the first hole.

Preferably, the volume adjustment device has a valve rod, a spring, a rotatable rod and a nut which is connected to the top of the space. The top of the valve rod is connected to the first end of the spring and the second end of the spring is in contact with the underside of the nut. The rotatable rod has a front end thereof extending through the nut and located in the spring. A distance is formed between the top of the valve rod and the front end of the rotatable rod. A knob is connected to the rotatable rod and exposed beyond the nut. The nut has a through hole which includes a first cylindrical portion and a second cylindrical portion which is smaller than the first cylindrical portion. A second stepped portion is defined between the first cylindrical portion and the second cylindrical portion. The lower end of the first cylindrical portion has a recessed portion and the second end of the spring is in contact with the recessed portion. The second cylindrical portion has inner threads and the rotatable rod has outer threads which are located corresponding to the inner threads.

Preferably, a fixing nut is connected between the nut and the knob.

Preferably, the length from the lower end to the pivotal position of the press rod is three to eight times of the length from the top end to the pivotal position of the press rod.

Preferably, the ratio between the length of the spring to the length of the inner diameter of the space is 1 to 3.

The travel of the valve rod of the volume adjustment device can be controlled by the movement of the rotatable rod within the space to adjust the volume of the air passing through the top path of the blow gun. Thanks to the high ratio between the inner diameter of the space and the outer diameter of the rotatable rod, the adjustable volume is larger than that of the conventional blow gun. The blowing pipe has a neck portion/cup member which is located adjacent to the exit of the blowing pipe. Two side holes are defined through the wall of the blowing pipe and located between the exit and the neck portion/cup member. The air speed passing through the neck portion/cup member becomes faster to form a vacuum area so that the outside air is sucked into the blowing pipe via the two side holes to increase the volume from the exit of the blowing pipe.

The rotatable rod and the spring share a common axis and is perpendicularly in contact with the press rod, the length of the spring is longer than that of the conventional blow gun, so that the blow gun is easily operated and the spring does not reach its fatigue point quickly, a longer life of use of the blow gun is expected.

The knob has larger outer diameter so that the user can easily rotate the knob with less effort. The length from the lower end to the pivotal position of the press rod is three to eight times of the length from the top end to the pivotal position of the press rod, so that the user requires only a limited force to trigger the press rod.

When the desired volume of air is reached by rotating the rotatable rod, the fixing nut is tightened to lock the rotatable rod to prevent the rotatable rod from further rotating to change the set volume. The press rod can also be locked to prevent the press rod from unintentionally triggering to activate the blow gun.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
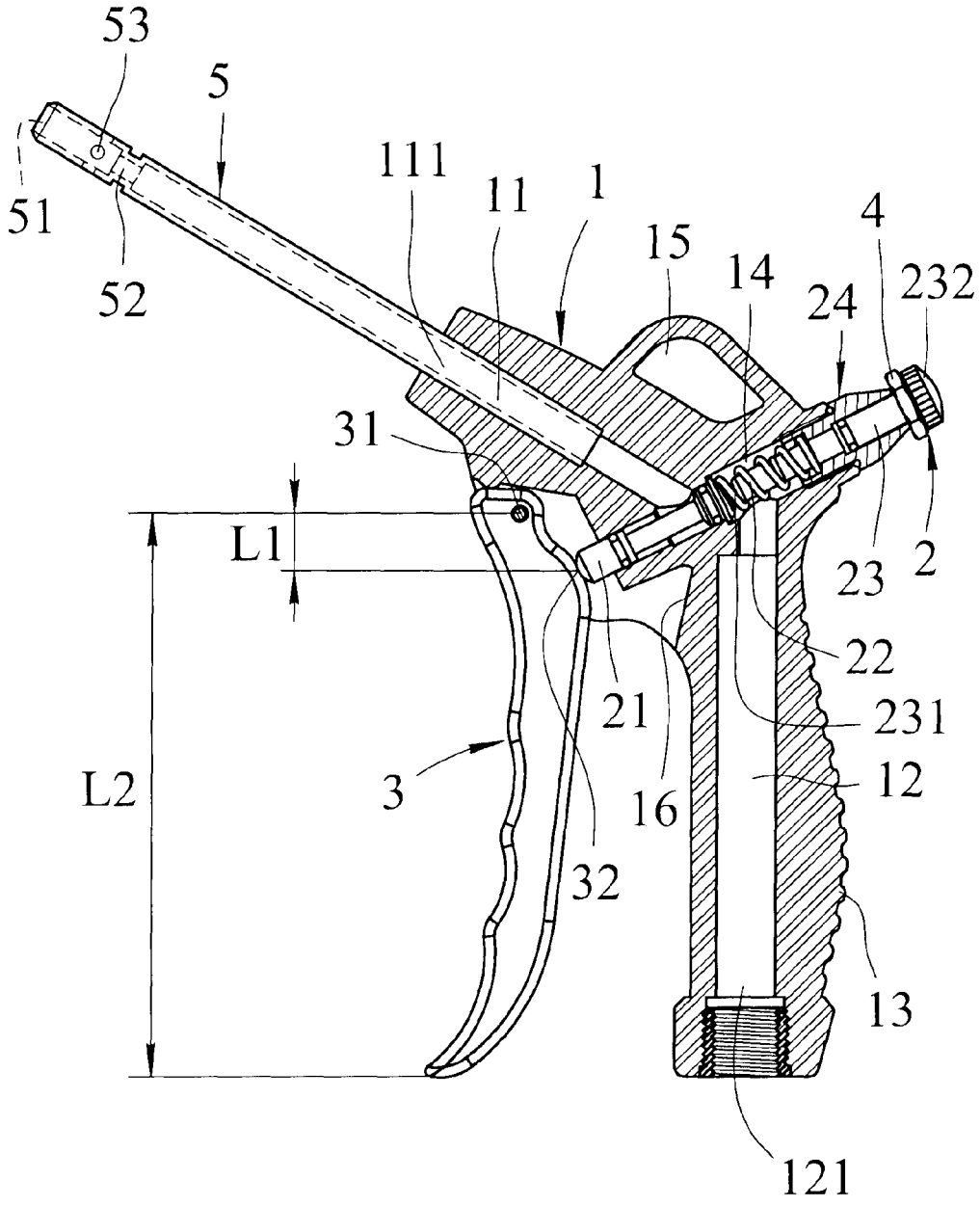
FIG. 1 is a cross sectional view showing the blow gun of the present invention.
Figure 2:
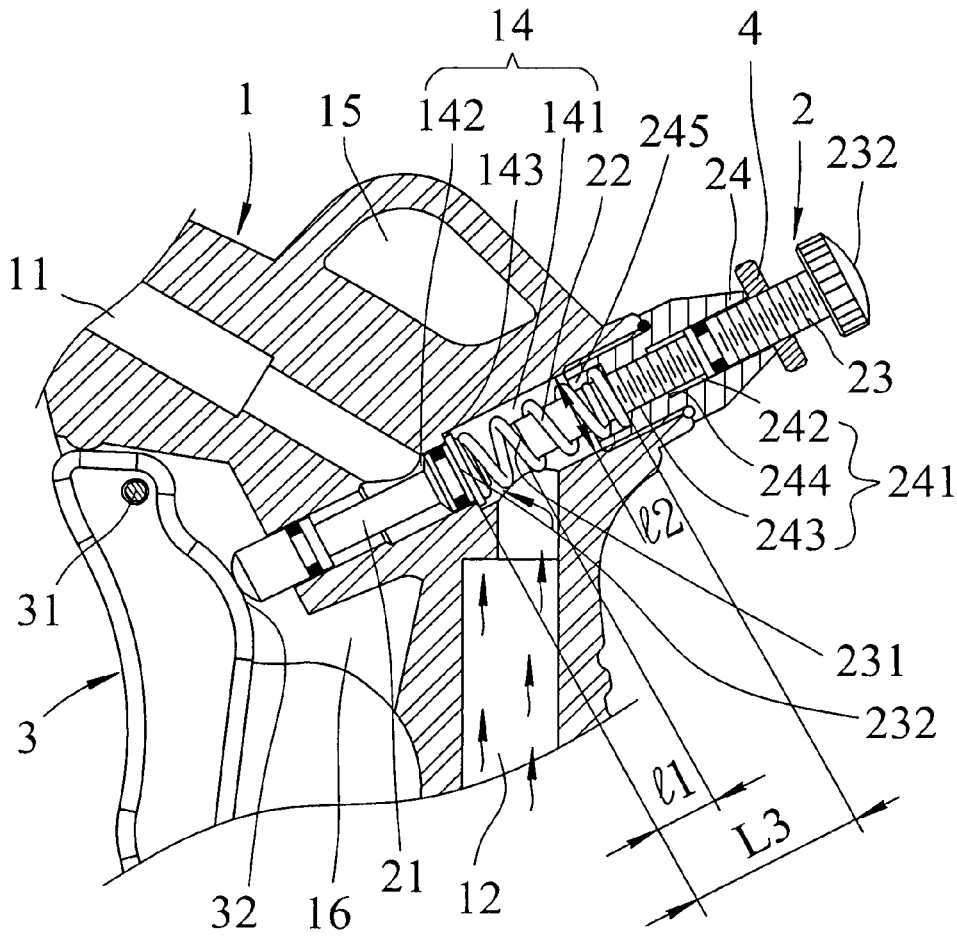
FIG. 2 is an enlarged cross sectional view showing a portion of the blow gun of the present invention.
Figure 3:
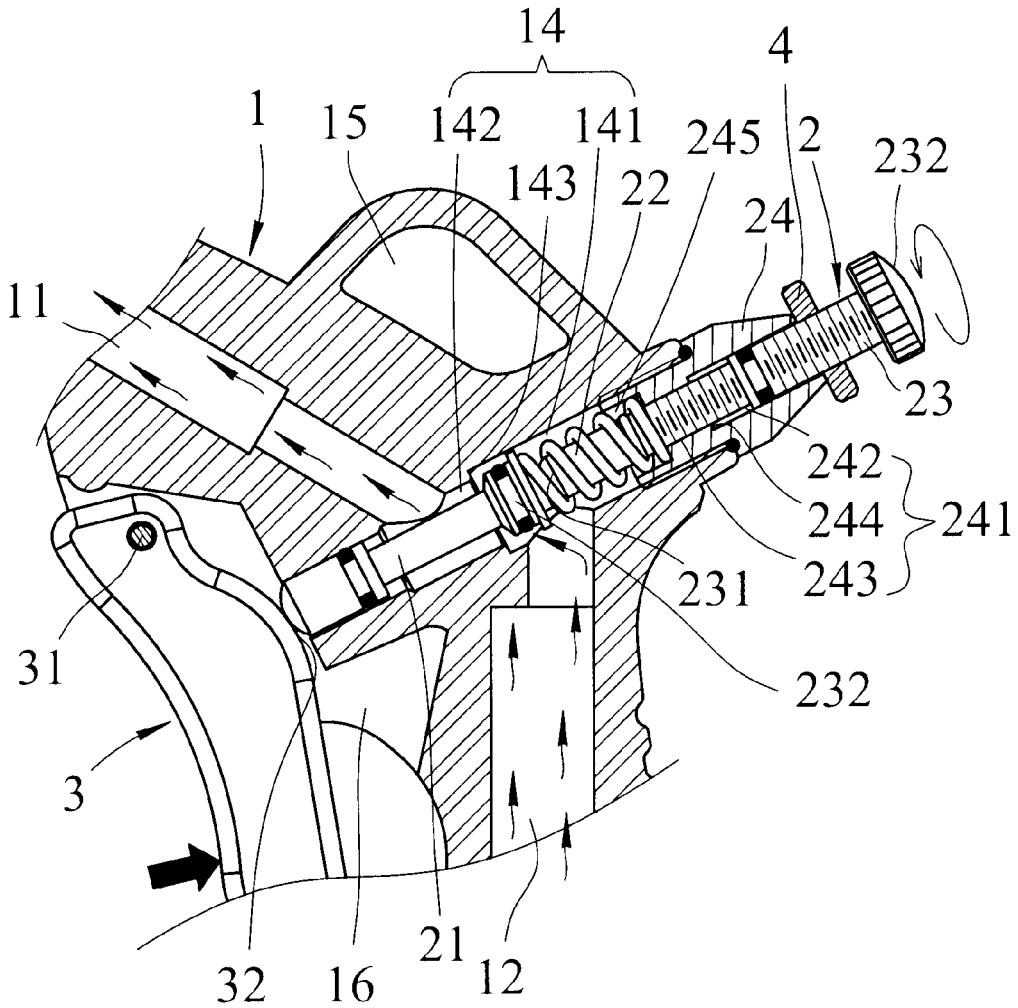
FIG. 3 is an enlarged cross sectional view showing that the press rod of the blow gun of the present invention is pushed.

Referring to FIGS. 1 to 3, the blow gun of the present invention comprises a body 1, a volume adjustment device 2, a press rod 3, a fixing nut 4 and a blowing pipe 5. The body 1 has a top path 11 and a bottom path 12. An inlet 121 communicates with the lower end of the bottom path 12 and an outlet 111 communicates with the top of the top path. A handle 13 is connected to the body 1 and a space 14 is defined in the body 1, wherein the space 14 communicates with the top and bottom paths 11, 12. The space 14 has a first hole 141 and a second hole 142 which is smaller than the first hole 141 so as to define a first stepped portion 143 between the first and second hole 141, 142. The top path 11 communicates with the second hole 142 and the bottom path 12 communicates with the first hole 141. A hanging hole 15 is formed at the top of the body 1 and a slot 16 is defined at a position where the press rod 3 is pivotably connected to the body 1.

The volume adjustment device 2 is installed in the space 14 and in contact with the protrusion 32 of the press rod 3 which has one end pivotably connected to the body 1 and is in contact with the lower end of the volume adjustment device 2.

The volume adjustment device 2 has a valve rod 21, a spring 22, a rotatable rod 23 and a nut 24. The nut 24 is connected to the top of the space 14 by the connection of inner and outer threads. The top of the valve rod 21 is connected to the first end of the spring 22 and the second end of the spring 22 is in contact with the underside of the nut 24. The rotatable rod 23 has a front end 231 thereof extending through the nut 24 and located in the spring 22. A distance "11" is formed between the top of the valve rod 21 and the front end 231 of the rotatable rod 23. A knob 232 is connected to the rotatable rod 23 and exposed beyond the nut 24. The nut 24 has a through hole 241 which includes a first cylindrical portion 242 and a second cylindrical portion 243 which is smaller than the first cylindrical portion 242. A second stepped portion 244 is defined between the first cylindrical portion 242 and the second cylindrical portion 243. The lower end of the first cylindrical portion 243 has a recessed portion 245 and the second end of the spring 22 is in contact with the recessed portion 245. The second cylindrical portion 243 has inner threads and the rotatable rod 23 has outer threads which are located corresponding to the inner threads.

The press rod 3 has one end pivotably connected to the pivotal hole 31 of the body 1 and is in contact with the lower end of the volume adjustment device 2. The length L2 from the lower end to the pivotal hole 31 wherein the press rod 3 is connected is three to eight times of the length L1 from the top end to the pivotal position of the press rod 3. The press rod 3 has a protrusion 32 which is located at the lateral side of the volume adjustment device 2. The protrusion 32 is in contact with the underside of the volume adjustment device 2.

The fixing nut 4 is connected between the nut 24 and the knob 232.

Figure 5:
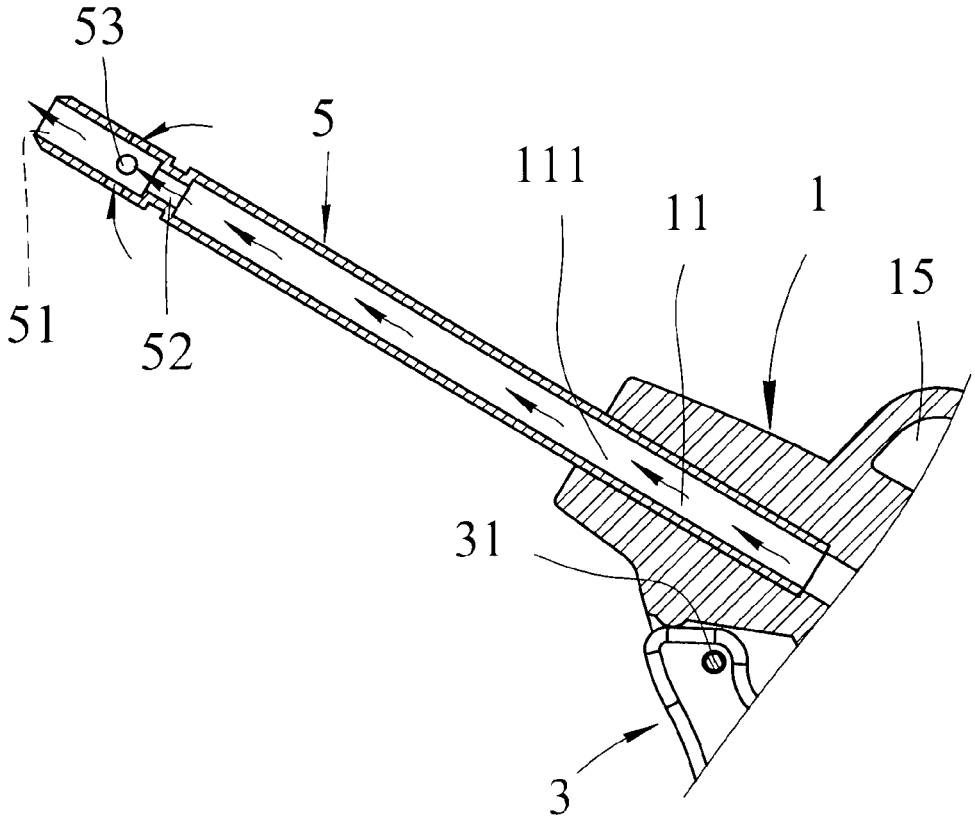
FIG. 5 shows the cross sectional view of the blowing pipe of the present invention.
Figure 6:
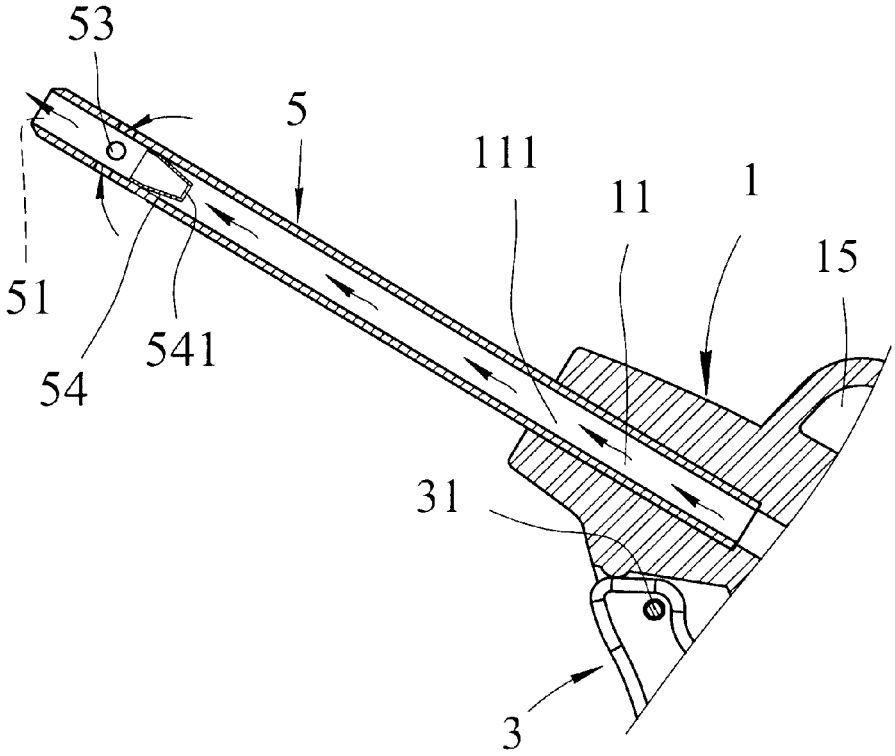
FIG. 6 shows the cross sectional view of another embodiment of the blowing pipe of the present invention.
Figure 7:
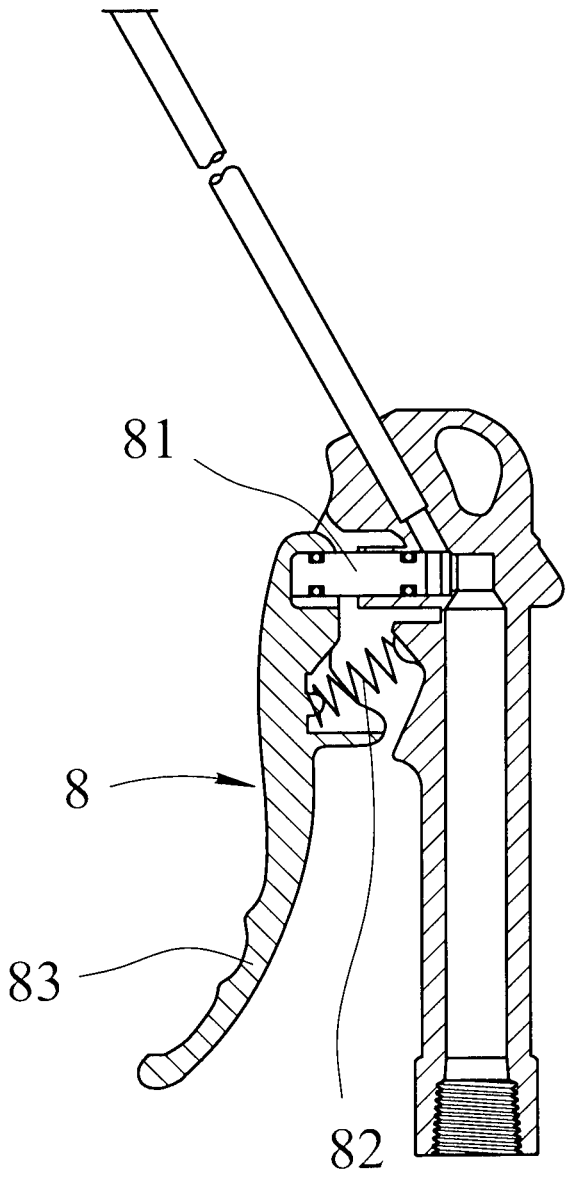
FIG. 7 PRIOR ART
FIG. 7 is a cross sectional view showing the conventional blow gun.
Figure 8:
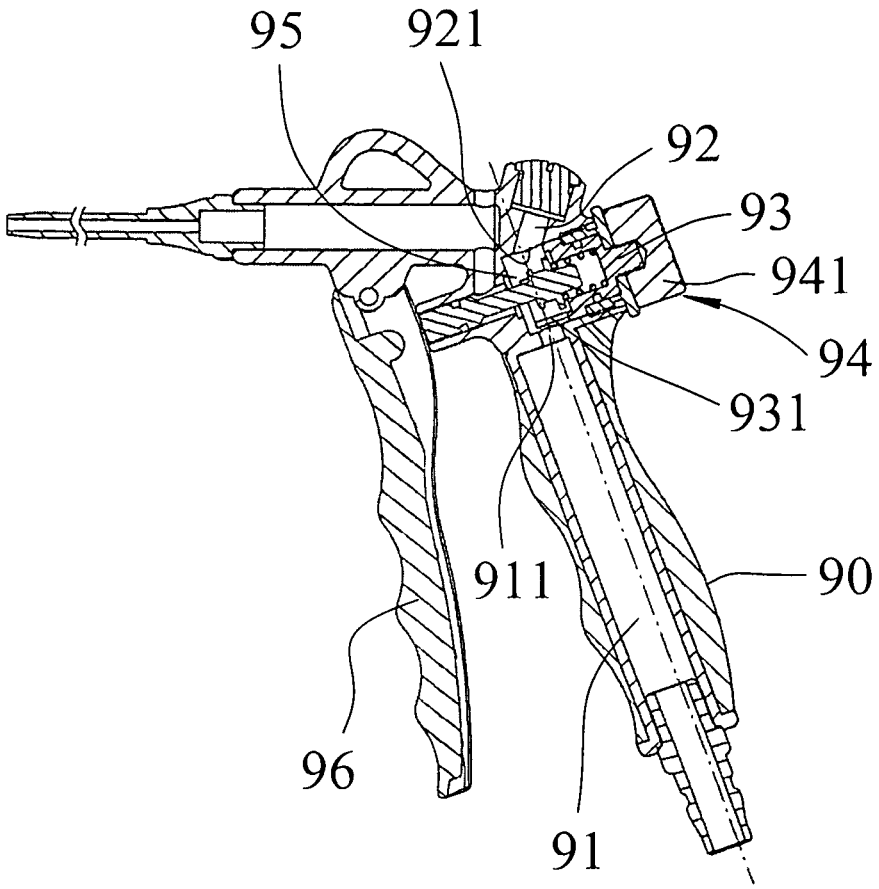
FIG. 8 PRIOR ART
FIG. 8 is a cross sectional view showing another conventional blow gun.

The blowing pipe 5 is connected to the top path 11 and has an exit 51. The blowing pipe 5 has a neck portion 52 or a cup member 54 received therein which is located adjacent to the exit 51 of the blowing pipe 5. Two side holes 53 are defined through the wall of the blowing pipe 5 and located between the exit 51 and the neck portion 52/cup member 54. As shown in FIGS. 5 and 6, the cup member 54 has an open end and an entrance 541 in a closed end thereof. The inner diameter of the entrance 541 is substantially the same as the inner diameter of the neck portion 52, about 3.5 mm, and the inner diameter of the blowing pipe 5 is about 6 mm.

As shown in FIGS. 2 and 3, the space 14 is defined between the top and bottom paths 11, 12, and the volume adjustment device 2 is installed in the space 14. The valve rod 21, the spring 22, the rotatable rod 23 and the nut 24 are installed in the space 14 in sequence. It is noted that the lower end of the valve rod 21 has to be in contact with the protrusion 32 of the press rod 3, and the nut 24 is partially exposed from the body 1. The knob 232 of the rotatable rod 23 is exposed from the outside of the nut 24. The distance "11" is formed between the top of the valve rod 21 and the front end 231 of the rotatable rod 23. The top of the valve rod 21 is connected to the first end of the spring 22 and the second end of the spring 22 is engaged with the recessed portion 245 of the rotatable rod 23. The distance "11" is the distance for the travel of the valve rod 21.

As shown in FIG. 3, when the rotatable rod 23 is located at the top position of the space 14, the valve rod 21 has the maximum displacement. In other words, the opening of the rotation of the press rod 3 is the maximum so that the blow gun has the maximum volume for blowing. When the knob 232 is rotated clockwise and the rotatable rod 23 is rotated, because of the engagement between the inner threads of the nut 24 and the outer threads of the rotatable rod 23, the rotatable rod 23 is lowered into the space 14 so that the distance "11" is reduced. In other words, the opening of the rotation of the press rod 3 is reduced and the volume for blowing is reduced. The distance "11" is reduced along with the clockwise rotation of the knob 232 so as to reduce the volume for blowing. When the knob 232 is rotated counter clockwise, the distance "11" is increased. In other words, the opening of the rotation of the press rod 3 is increased and the volume for blowing is increased. It is noted that the ratio between the inner diameter "12" of the space 14 and the outer diameter of the rotatable rod 13 is larger than that of the conventional blow gun, the maximum volume of the blow gun of the present invention is larger than that of the conventional blow gun.

The length "L3" of the spring is longer than that of the conventional blow gun, so that the blow gun is easily operated and the spring does not reach its fatigue point quickly, a longer life of use of the blow gun is expected.

The blowing pipe 5 is connected to the top path 11 and has an exit 51. The blowing pipe 5 has a neck portion 52/cup member 54 received therein which is located adjacent to the exit 51 of the blowing pipe 5. Two side holes 53 are defined through the wall of the blowing pipe 5 and located between the exit 51 and the neck portion 52/cup member 54. As shown in FIGS. 5 and 6, the air speed passing through the neck portion 52/cup member 54 becomes faster to form a vacuum area so that the outside air is sucked into the blowing pipe 5 via the two side holes 53 to increase the volume from the exit 51 of the blowing pipe 5.

Figure 4:
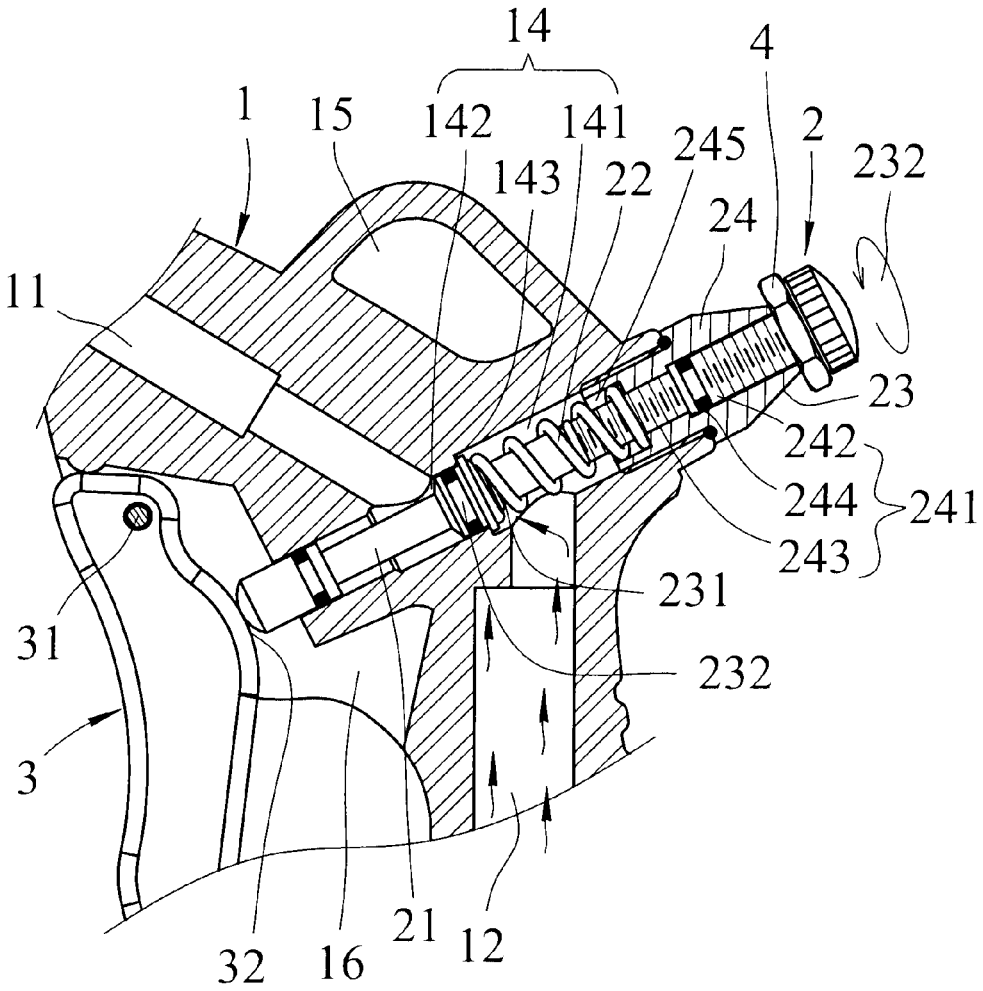
FIG. 4 is an enlarged cross sectional view showing that the press rod of the blow gun of the present invention is locked.

As shown in FIG. 4, when the blow gun is not in use, the rotatable rod 23 is rotated to its lowest position and the knob 232 is rotated to its lowest position. The distance "11" is zero in this status so that the valve rod 21 does not have space to move and the press rod 3 does not any space to be operated to blow air. Therefore, even if the press rod 3 is unintentionally touched, the blow gun is not activated.

It is noted that before the knob 232 is rotated, the fixing nut 4 has to be loosened so that the even if the knob 232 is unintentionally touched, if the fixing nut 4 is not loosened, the rotatable rod 23 is not rotated to change the set volume.

While we have shown and described the embodiment in accordance with the present invention, it should be clear to those skilled in the art that further embodiments may be made without departing from the scope of the present invention.

What is claimed is:

1. A blow gun comprising:

a body having a top path and a bottom path, an inlet communicating with a lower end of the bottom path, an outlet communicating with a top of the top path, a handle connected to the body and a space defined in the body, the space communicating with the top and bottom paths, the space having a first hole and a second hole which is smaller than the first hole so as to define a first stepped portion between the first and second hole, the top path communicating with the second hole and the bottom path communicating with the first hole;

a volume adjustment device installed in the space and being in contact with a press rod which has one end pivotably connected to the body and being in contact with a lower end of the volume adjustment device, the volume adjustment device having a valve rod, a spring, a rotatable rod and a nut, the nut connected to a top of the space, a top of the valve rod connected to a first end of the spring, a second end of the spring being in contact with an underside of the nut the rotatable rod having a front end thereof extending through the nut and located in the spring, a distance being formed between the top of the valve rod and the front end of the rotatable rod, a knob connected to the rotatable rod and exposed beyond the nut, and a blowing pipe connected to the top path and having an exit.

2. The blow gun as claimed in claim 1, wherein the nut has a through hole which includes a first cylindrical portion and a second cylindrical portion which is smaller than the first cylindrical portion, a second stepped portion is defined between the first cylindrical portion and the second cylindrical portion, a lower end of the first cylindrical portion has a recessed portion and the second end of the spring is in contact with the recessed portion, the second cylindrical portion has inner threads and the rotatable rod has outer threads which are located corresponding to the inner threads.

3. The blow gun as claimed in claim 1, wherein a fixing nut is connected between the nut and the knob.

4. The blow gun as claimed in claim 1, wherein the body has a slot defined at a position where the press rod is pivotably connected to the body.

5. The blow gun as claimed in claim 1, wherein the press rod has a protrusion which is located at a lateral side of the volume adjustment device.

6. The blow gun as claimed in claim 1, wherein a length from a lower end of the press rod to a pivotal position of the press rod is three to eight times of a length from a top end of the press rod to the pivotal position of the press rod.

7. The blow gun as claimed in claim 1, wherein a ratio between a length of the spring to a length of an inner diameter of the space is 1 to 3.

* * * * *